US006250452B1

(12) United States Patent
Partyka et al.

(10) Patent No.: US 6,250,452 B1
(45) Date of Patent: Jun. 26, 2001

(54) VENDING DATA COLLECTION SYSTEM

(75) Inventors: Kenneth M. Partyka, Circle Pines; David J. Pogoff, Hopkins; Michell H. Cochran, Eagan; Michael L. Gannon, St. Paul, all of MN (US)

(73) Assignee: Cimetrics, Inc., Boston, MA (US)

( * ) Notice: Subject to any disclaimer, the term of this patent is extended or adjusted under 35 U.S.C. 154(b) by 0 days.

(21) Appl. No.: 09/328,617

(22) Filed: Jun. 9, 1999

Related U.S. Application Data

(63) Continuation of application No. 08/688,722, filed on Jul. 31, 1996, now Pat. No. 5,941,363.

(51) Int. Cl.[7] ..... G07F 5/22

(52) U.S. Cl. ..... 194/217; 221/6; 700/236; 700/241

(58) Field of Search ..... 194/217; 700/231, 700/232, 236, 241; 221/6, 14, 129

(56) References Cited

U.S. PATENT DOCUMENTS

| | | | |
|---|---|---|---|
| 3,365,044 | 1/1968 | Ptacek | 194/217 |
| 3,367,467 | 2/1968 | Ptacek | 194/206 |
| 3,472,424 | 10/1969 | Offutt et al. | 221/129 |
| 3,656,145 | 4/1972 | Proops | 340/310 |
| 3,718,906 | 2/1973 | Lightner | 340/147 |
| 4,241,237 | 12/1980 | Paraskevakos et al. | 179/2 |
| 4,412,292 | 10/1983 | Sedam et al. | 264/479 |
| 4,478,353 | 10/1984 | Levasseur | 221/14 |
| 4,520,451 | 5/1985 | McLaughlin | 364/900 |
| 4,598,378 | 7/1986 | Giacomo | 364/479 |
| 4,611,205 | 9/1986 | Eglise | 340/825.35 |
| 4,616,323 | 10/1986 | Hayashi | 364/479 |
| 4,654,800 | 3/1987 | Hayashi et al. | 364/479 |
| 4,713,761 | 12/1987 | Sharpe et al. | 364/406 |
| 4,722,058 | 1/1988 | Nakayama et al. | 364/479 |
| 4,766,548 | 8/1988 | Cedrone et al. | 364/479 |
| 4,845,636 | 7/1989 | Walker | 364/479 |
| 4,853,684 | 8/1989 | Hoppstadter | 340/825.35 |
| 4,866,661 | 9/1989 | de Prins | 364/900 |
| 4,986,615 | 1/1991 | Hieb et al. | 312/45 |
| 5,029,098 | 7/1991 | Levasseur | 364/479 |
| 5,036,966 | 8/1991 | Kasper et al. | 194/217 |
| 5,091,713 | 2/1992 | Horne et al. | 340/541 |
| 5,113,351 | 5/1992 | Bostic | 364/479 |
| 5,159,560 | 10/1992 | Newell et al. | 364/479 |
| 5,176,288 | 1/1993 | Craven | 221/124 |
| 5,194,856 | 3/1993 | Zijlstra | 340/825.35 |
| 5,207,784 | 5/1993 | Schwartzendruber | 221/6 |
| 5,282,127 | 1/1994 | Mii | 364/130 |
| 5,321,625 | 6/1994 | Humm et al. | 364/479 |
| 5,337,253 | 8/1994 | Berkovsky et al. | 364/479 |
| 5,339,250 | 8/1994 | Durbin | 364/479 |
| 5,367,452 | 11/1994 | Gallery et al. | 364/401 |
| 5,381,462 | 1/1995 | Larson et al. | 379/107 |
| 5,400,253 | 3/1995 | O'Connor | 364/442 |
| 5,608,643 | 3/1997 | Wichter et al. | 364/479.14 |
| 5,631,724 | 5/1997 | Sawada et al. | 355/205 |
| 5,694,323 | 12/1997 | Koropitzer et al. | 364/464.1 |

FOREIGN PATENT DOCUMENTS

| | | | |
|---|---|---|---|
| 09/05609 | 2/1995 | (WO) | 364/479 |

*Primary Examiner*—F. J. Bartuska
(74) *Attorney, Agent, or Firm*—Brown, Pinnisi & Michaels, P.C.

(57) ABSTRACT

A monitoring system monitors a plurality of remote product dispensers. Vends are detected indicating that products have been dispensed from the dispenser during a given time period. Vend data indicative of the products dispensed is stored. The vend data is communicated to a base unit and a base unit provides a display indicative of products dispensed and a service schedule based on the vend data received.

12 Claims, 8 Drawing Sheets

104
122
POWER SUPPLY
120
MICROCONTROLLER
128
STATIC RAM, ROM STORAGE
SERIAL INTERFACE
CAPACITOR BACKUP
130
124
LOCAL AREA COMMUNICATIONS INTERFACE (PLC,RF)
SERIAL INTERFACE
126
WIDE AREA COMMUNICATIONS INTERFACE (PSTN, CDPD, CELLULAR)
TO/FROM COMMUNICATION INTERFACE 114
TO/FROM HOST 106

VENDING DATA COLLECTION SYSTEM

REFERENCE TO RELATED APPLICATIONS

This is a continuation patent application of application Ser. No. 08/688,722, filed Jul. 31, 1996, entitled "VENDING DATA COLLECTION SYSTEM", now U.S. Pat. No. 5,941,363, incorporated herein by reference.

BACKGROUND OF THE INVENTION

The present invention deals with remote monitoring. More specifically, the present invention deals with remotely monitoring and collecting vend data from a plurality of vending systems.

Vending machines are currently in wide use, and typically involve a remote machine holding a plurality of products or items to be dispensed after receiving money from a purchaser. Most such machines are electromechanically controlled. Such electromechanical machines typically include devices referred to as a coin changer and a bill validator for receiving money from a customer. The machines also typically include a plurality of bins for holding different products to be sold. A plurality of customer inputs are provided (such as buttons) through which the customer can indicate a desired product. Vend motors are located proximate the various bins to dispense a product from one of the bins upon actuation. Upon receiving adequate monetary input, the coin changer provides a credit output which energizes a credit relay. The credit relay provides power to a circuit which powers both a product out light and the vend motor. Once the credit relay is energized, and if the purchaser actuates one of the purchaser input buttons, the appropriate vend motor is energized so that it rotates to dispense a product.

Prior vending machine monitoring systems have also been attempted. Such systems have been put in place in hopes of gathering vend data from vending machines. However, such prior systems have proven to be highly inaccurate and ineffective. For example, hand held computers are currently available which can be coupled to some vending machines to receive some items of information about previous vending transactions. The information received includes, for instance, the level of coins in the coin changer. However, no information regarding the number of vends in any particular bin within the machine is transmitted. Further, such hand held computers require a service person to travel to the machine to find out whether a service call is needed. Thus, such a system is economically wasteful.

SUMMARY OF THE INVENTION

The present invention arises, in part, from the realization that simply monitoring the vend motor circuits to determine whether a vend has occurred produces results which are highly inaccurate. For example, conventional wisdom teaches that by monitoring the vend motor circuit, and determining when the motor circuit is energized correlates to a vend. However, it has been determined that in most currently available vending machines, the vend motor can be energized for different time periods for many different reasons. In different vending machines, the vend motor can require a different degree of rotation to accomplish a vend. Also, if the operator actuates the product selector button for an inadequate duration, the vend motor starts but stops before a vend has occurred. This is referred to as a "quick hit" and can occur many times before the vend actually occurs. Systems which count a vend with each energization of the motor circuit count all quick hits as vends and are erroneous.

In addition, in most currently used vending machines, the product out light which indicates that a bin is out of a certain product is also coupled into the power circuit which powers the vend motor. When a product is depleted from a bin, the motor circuit is energized and a relay downstream of the product out light cuts out the motor so that it does not continuously turn. However, the motor circuit still appears to be energized. Thus, simply monitoring the vend motor circuit, and the time during which it is activated, can lead to inaccurate results.

Applicants' invention also arises, in part, from the realization that once accurate vend data is obtained, it would be desirable to use the data in determining an improved service schedule for servicing the machine.

A monitoring system monitors a plurality of remote product dispensers. Vends are detected indicating that products have been dispensed from the dispenser during a given time period. Vend data indicative of the products dispensed is stored. The vend data is communicated to a base unit and a base unit provides a display indicative of products dispensed and a service schedule based on the vend data received.

DETAILED DESCRIPTION OF THE PREFERRED EMBODIMENTS

Figure 1:
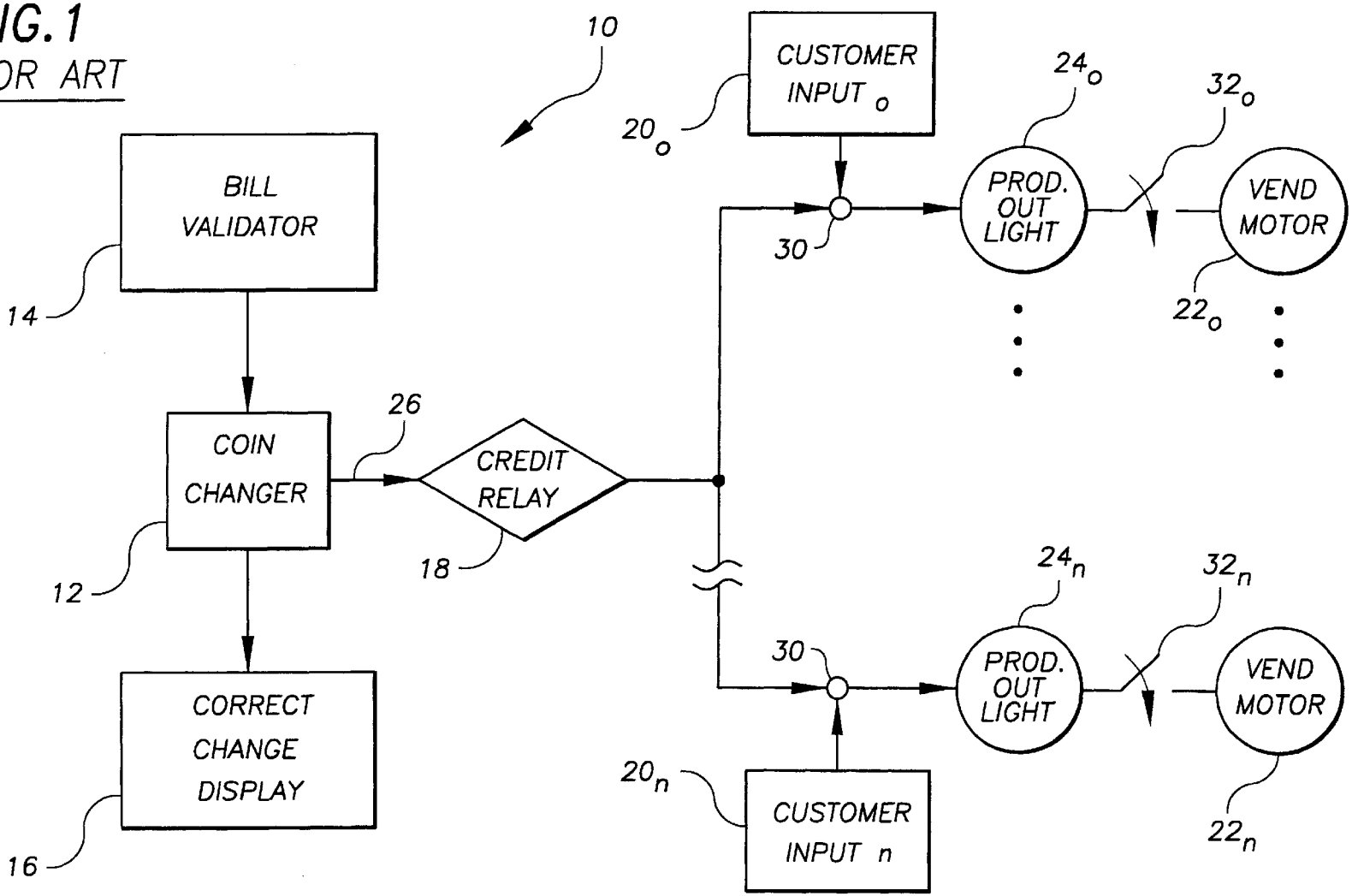
FIG. 1 PRIOR ART
FIG. 1 is a block diagram of a portion of a typical vending machine.

FIG. 1 shows a block diagram of a portion of a vending machine 10 according to the prior art. In the embodiment shown in FIG. 1, the vending machine is a conventional, electromechanically operated, soft drink vending machine. Vending machine 10 includes coin changer 12, bill validator 14, correct change display 16, credit relay 18, operator inputs $\mathbf{20}_0$–$\mathbf{20}_n$, vend motors $\mathbf{22}_0$–$\mathbf{22}_n$ and product out displays $\mathbf{24}_0$–$\mathbf{24}_n$.

Coin changer 12 is configured to receive coins from a customer or purchaser. Bill validator 14 is configured to accept bills from a customer or purchaser. Bill validator 14 provides an output signal to coin changer 12 in response to receiving a valid bill. In one embodiment of machine 10, the signal provided by bill validator 14 is a five volt DC signal having a steady state which indicates the presence or absence of a valid bill. Coin changer 12 or bill validator 14, or a combination thereof, can be simply an electronic circuit with a desired monetary input set by a series of switches, or a computer controlled circuit wherein the computer receives necessary inputs and provides the output signals discussed below.

When coin changer 12 receives enough money, either by receiving coins from a customer, or by receiving the bill valid signal from bill validator 14, coin changer 12 provides a credit signal at output 26. The credit signal at output 26 has a potential of 120 volts AC when credit has been established, and has no potential when no credit has been established. The credit signal latches up credit relay 18 which provides power to input circuits 30. Circuits 30 also receive an input from operator inputs 20. Customer inputs $\mathbf{20}_0$–$\mathbf{20}_n$ are n+1 separate product selector buttons actuable upon depression by the customer. Once credit has been established, the customer actuates one of customer inputs $\mathbf{20}_0$–$\mathbf{20}_n$. In response, a signal is provided to the appropriate circuit 30 and power is provided to one of vend motors $\mathbf{22}_0$–$\mathbf{22}_n$. The power is supplied for a period long enough to allow the vend motor to rotate far enough to dispense the desired product.

Vend motors $\mathbf{22}_0$–$\mathbf{22}_n$ also have associated relays $\mathbf{32}_0$–$\mathbf{32}_n$. These relays cut vend motors $\mathbf{22}_0$–$\mathbf{22}_n$ out of the power circuit when the product loaded in the bin associated with the particular vend motor 22 has been depleted. It should also be noted that, while the relays are illustrated as relays 32 in FIG. 1 and are energized based on suitable detectors which detect the bin being out of product, they could be embodied as any suitable circuit configuration for selectively removing vend motors 22 from the power circuit.

Further, FIG. 1 is merely a simplified block diagram which illustrates the basic principles of operation of such vending machines. It is not to be taken as a complete diagram of such vending machines.

Figure 1A:
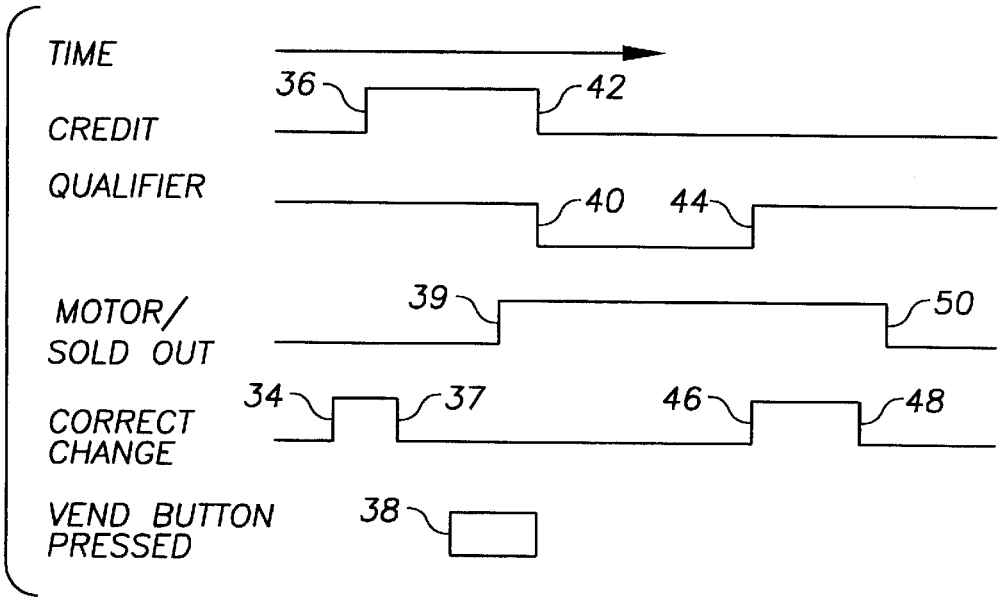
FIGS. 1A–1H are timing diagrams which illustrate the operation of conventional vending machines during a plurality of different operations.

FIGS. 1A–1H are timing diagrams which illustrate the specific timing of the various signals in vending machines 10 to illustrate operation in greater detail. FIGS. 1A–1F illustrate timing diagrams for cycles performed using conventional vending machines commercially available such as certain machines sold under the commercial designation Dixie-Narco. FIG. 1A shows a timing diagram for a normal vend cycle in which no items are sold out and in which correct change is not required. The customer first deposits coins (or a bill) in coin changer 12 (or bill validator 14). At some point, when coin changer 12 receives enough money, it activates the correct change signal at 34 and the credit signal (illustrated by arrow 26 in FIG. 1) at 36. While these signals 34 and 36 are nearly simultaneous, signal 36 is slightly delayed because it is not active until the credit relay latches up. The correct change signal then goes inactive at 37. The system does not change state until the customer presses one of customer inputs $\mathbf{20}_0$–$\mathbf{20}_n$ illustrated at 38. At that time, one of vend motors $\mathbf{22}_0$–$\mathbf{22}_n$ receives power and begins to rotate. This is illustrated at 39. A qualifier signal provided in the machine then goes to an asserted or active state at 40 which clears the credit signal at 42. The qualifier signal goes to a deasserted level at 44 causing the correct change signal to go to an asserted level at 46. Some time later, the correct change signal goes to a deasserted level at 48 and the particular vend motor 22 stops rotating at 50. Machine 10 then remains in this state until a customer adds money to coin changer 12 or bill validator 14 at which point the vend cycle starts anew.

Figure 1B:
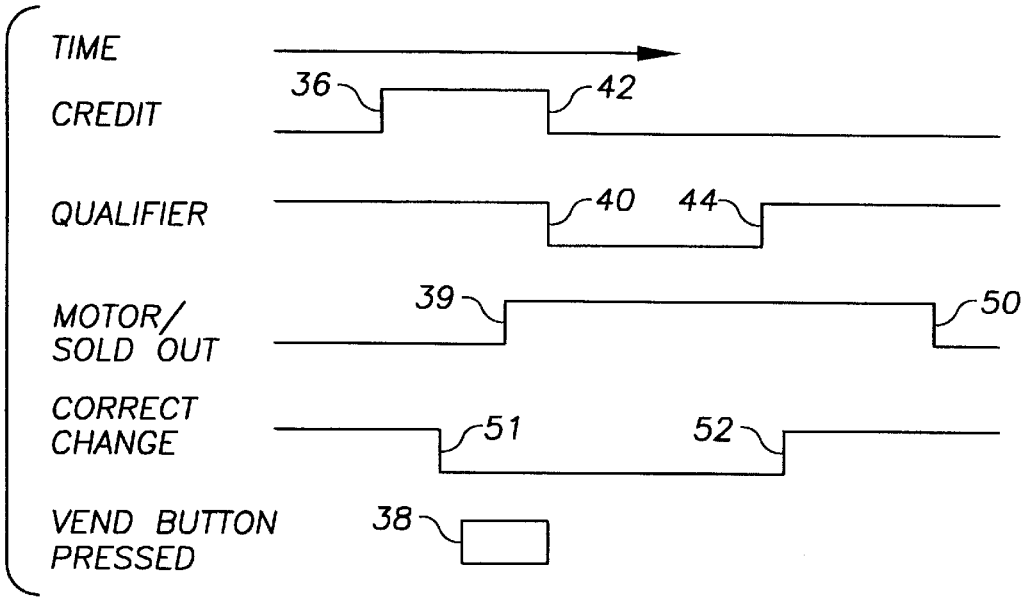

FIG. 1B illustrates a normal vend sequence with no items sold out, but when correct change is required both at the beginning of the vend cycle and at the end of the vend cycle. The sequence is similar to that shown in FIG. 1A and similar signal transitions are similarly numbered. However, the correct change signal behaves differently than shown in FIG. 1A. When coin changer 12 has received adequate credit at 36, the correct change signal is in the asserted state indicating to the purchaser that correct change is required. However, the correct change signal goes to a deasserted state at 51 and remains there until the customer presses a selection at 38. Once the qualifier signal returns to its deasserted state at 44, the correct change signal returns to the asserted state at 52. The machine then remains in this state until a customer adds money.

Figure 1C:
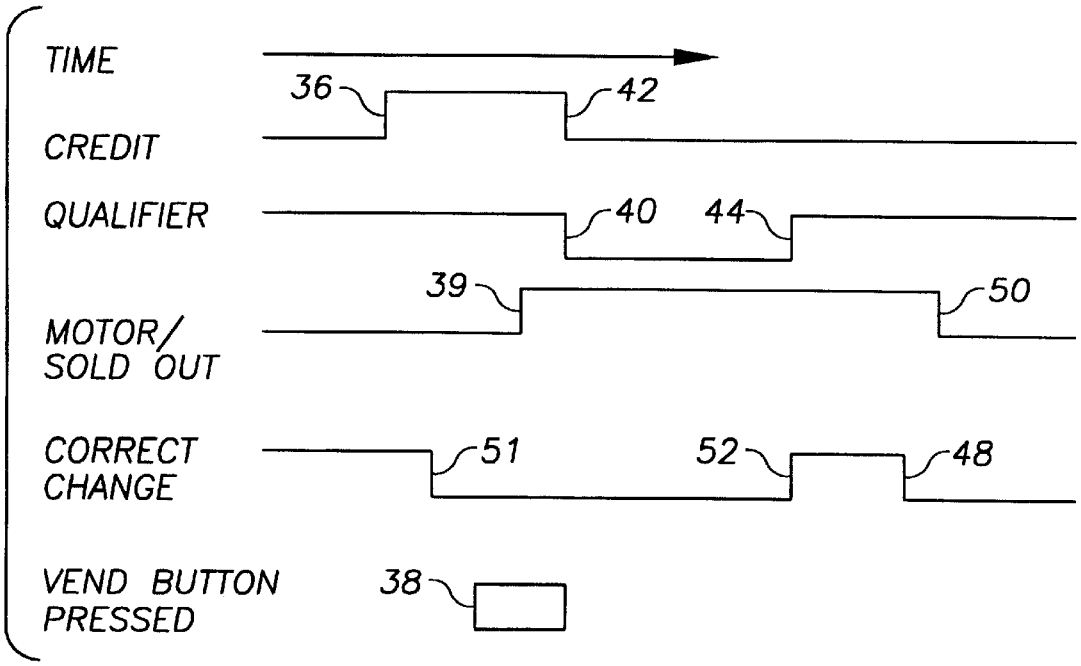

FIG. 1C shows a timing diagram for a normal vend in which correct change was required at the beginning of the vend, but is not required after the vend. The signal transitions are similar to those shown in FIGS. 1A and 1B and are similarly numbered. The only difference is that, after the vend cycle, the correct change signal goes to its deasserted position at 48, rather than remaining asserted as in FIG. 1B.

Figure 1D:
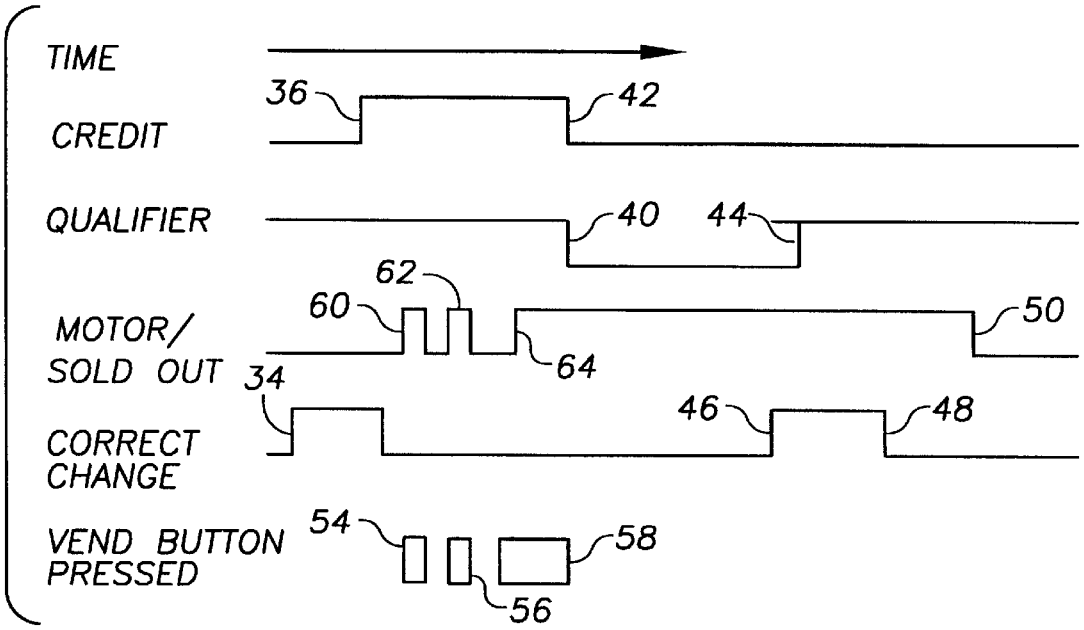

FIG. 1D is a timing diagram illustrating a normal vend cycle with what is referred to as a "quick hit". Since vending machine 10 has electromechanical switch mechanisms that require motors 22 to turn some minimum amount before the motor 22 runs without the customer input switch being depressed, motor 22 will stop unless customer input switch 20 is depressed for a sufficient duration. In this instance, the customer does not hold down the customer input button 20 for a duration which is adequate for the appropriate vend motor 22 to stay running. Instead, the customer quickly actuates the customer input 20 and allows it to deactuate. The signal transitions are similar to those illustrated in the previous figures, and are similarly numbered. However, in the illustration of FIG. 1D, the customer actuates the customer input switch 20 three times shown at 54, 56 and 58. The actuations at 54 and 56 are of insufficient duration. Therefore, when the customer actuates the switch at 54 and 56, the motor begins running at 60 and 62 but stops until the customer actuates the customer input switch 20 at 58 for a duration long enough to allow the motor to continue running at 64.

Figure 1E:
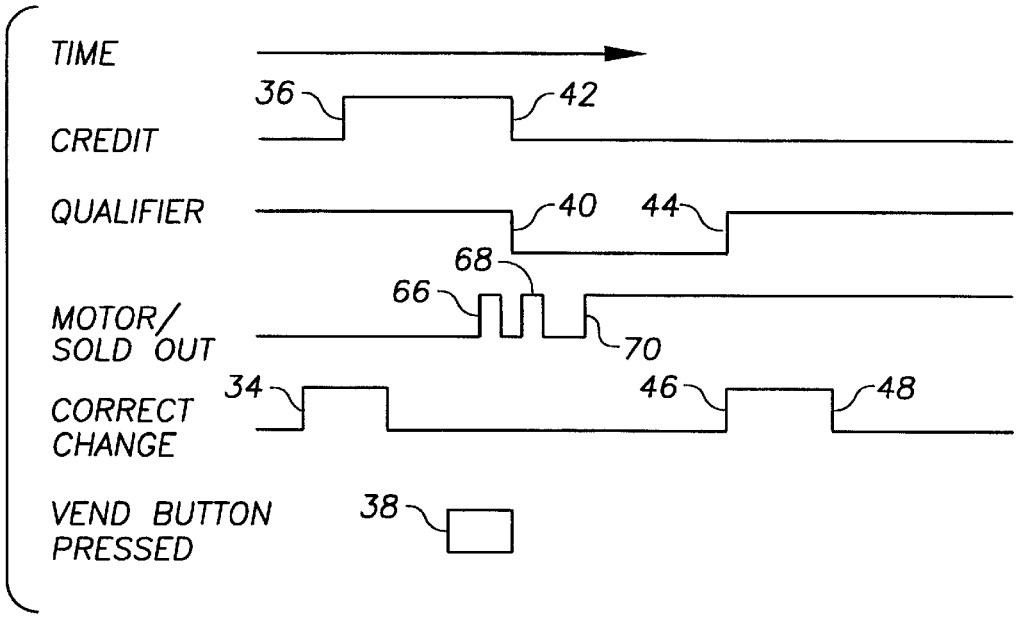

FIG. 1E illustrates a timing diagram for a normal vend cycle with the item vended going to a sold out status. A number of the signal transitions are similar to those shown in the previous timing diagrams and are similarly numbered. As the last vended product (such as a can of soda) drops out of the bin in which it was contained, a paddle at the bottom of the bin, which extends into a vend chute leading out of the bin, returns to an empty position which causes switches in the vending machine to activate sold out light 24. However, such paddles tend to bounce thereby causing the motor/sold out signal to bounce or glitch at 66 and 68. After settling out at 70, the motor/sold out signal remains in an asserted position. This condition causes an opening of switch 32 thereby precluding the corresponding motor 22 from operating until the machine is restocked.

Figure 1F:
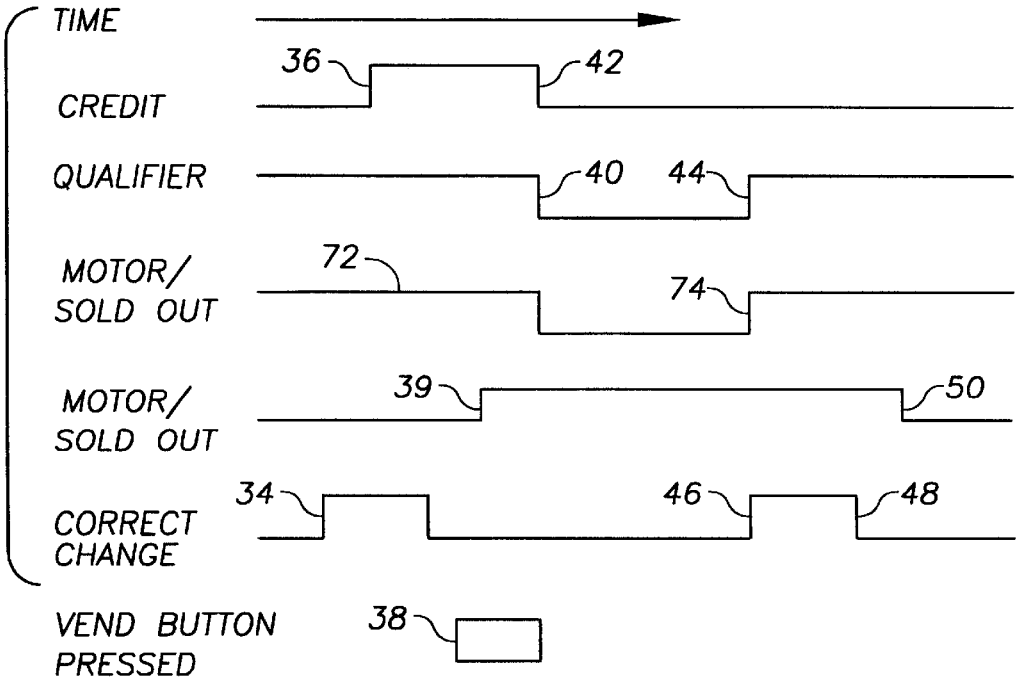

FIG. 1F illustrates a timing diagram for a normal vend cycle with other products (other than the selected product) sold out. Some of the signal transitions are similar to those in the previous diagrams and are similarly numbered. FIG. 1F shows two motor/sold out signals. The first shows that the motor/sold out signal is in an asserted position at 72 indicating that the product associated with that motor or bin is currently sold out. The second is a normal motor/sold out signal for the vended article which goes asserted at 39 and deasserted at 50. Note that when the qualifier signal becomes asserted at 40, it causes the motor/sold out signal previously in the sold out state to become deasserted. Also, when the qualifier signal becomes deasserted at 44, it causes the same motor/sold out signal to become asserted again at 74.

Figure 1G:
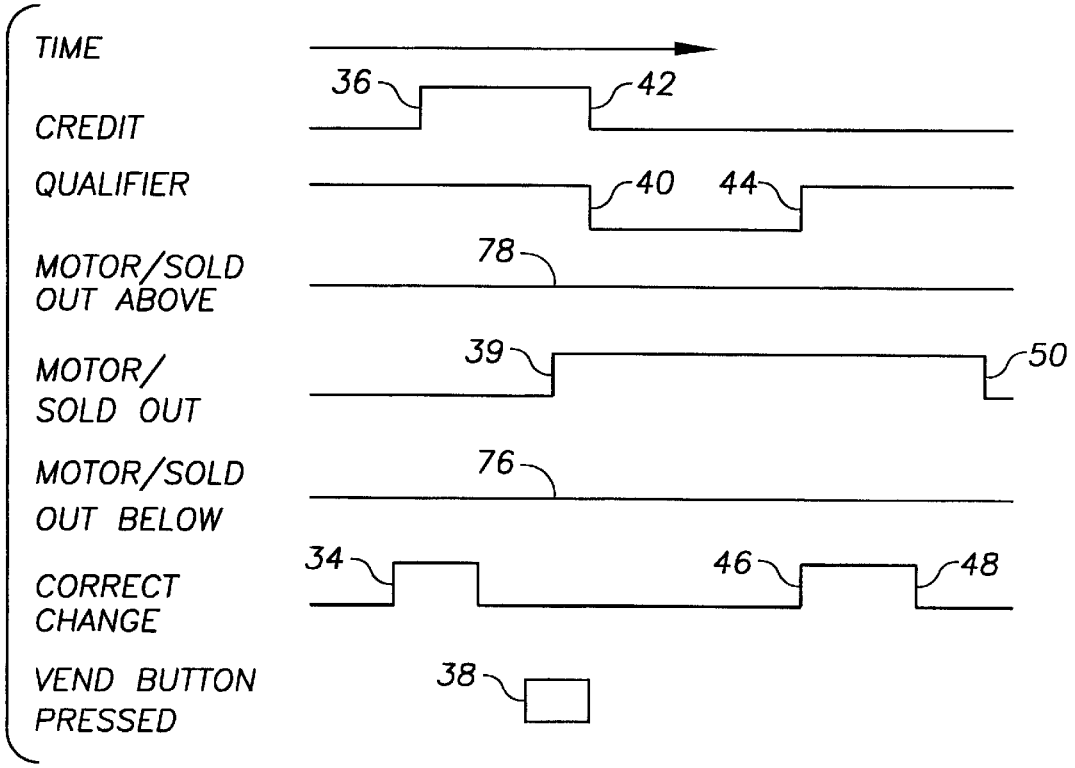

The timing diagrams set out in FIGS. 1A–1E above are identical for another commercially available vending machine such as those under the commercial designation Vendo. However, for Vendo machines manufactured during a certain time period (such as the Vendo O1C3928-407), the timing diagram is slightly different for a normal vend with other items sold out. This is illustrated in FIG. 1G. Some signal transitions are similar to those shown in FIG. 1F and are similarly numbered. However, for products which are sold out in bins located above and below the vended product, the motor/sold out signals simply stay asserted as shown at 76 and 78.

Figure 1H:
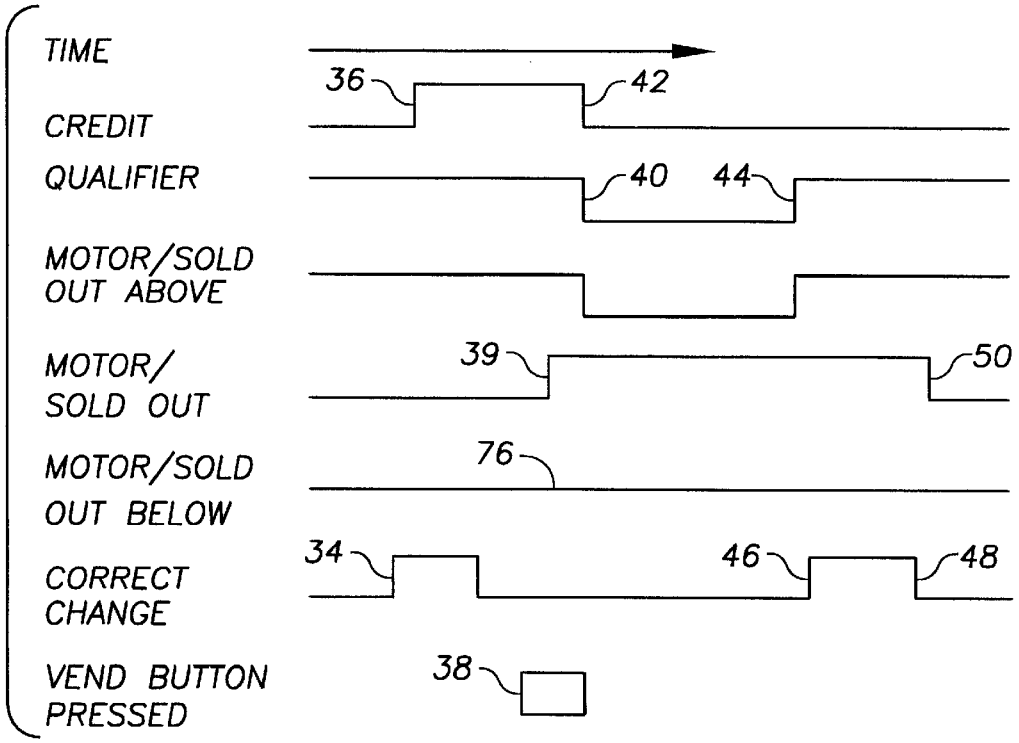

FIG. 1H illustrates a timing diagram for a normal vend cycle with other items sold out for still other date ranges of Vendo machines such as the Vendo V247-245 and the Vendo O1C4078-229. Similar signal transitions are numbered similarly to those shown in FIG. 1G. The motor/sold out signal for the bins above and below the selected product are initially asserted indicating that the product is sold out. Note, however, that the motor/sold out signal for the bin above the vended article follows the qualifier signal while the motor/sold out signal for the bin below the vended article remains in the asserted position throughout the cycle.

A small but growing percentage of vending machines currently on the market are computer controlled vending machines. Such machines include certain machines under the commercial designations Dixie-Narco and Royal Merlin. Such machines operate in a fairly straight forward manner. A majority of the inputs from the operator and the coin changer are provided to a microprocessor, and the microprocessor simply energizes appropriate relays based on the customer inputs to cause a desired vend motor to turn. Typically, such machines have separate product sold out lights and separate switches. Thus, in order to monitor vends in such a machine, one simply needs to monitor the output from the microprocessor to the various vend motor relays to determine when a vend has occurred.

In accordance with one preferred embodiment of the present invention, the qualifier signal is monitored along with the motor/sold out signal to determine whether a vend has occurred. However, in some machines, the qualifier signal is not easily accessible. Therefore, in accordance with another preferred embodiment of the present invention, the credit signal, the motor/sold out signal, and the correct change signal in the electromechanically controlled machines are all monitored in order to determine, with a great deal of accuracy, whether a vend has taken place. This monitoring system works for all of the machines discussed above and is believed to work with substantially all currently available vending machines of this type. This is described in greater detail below.

Figure 2:
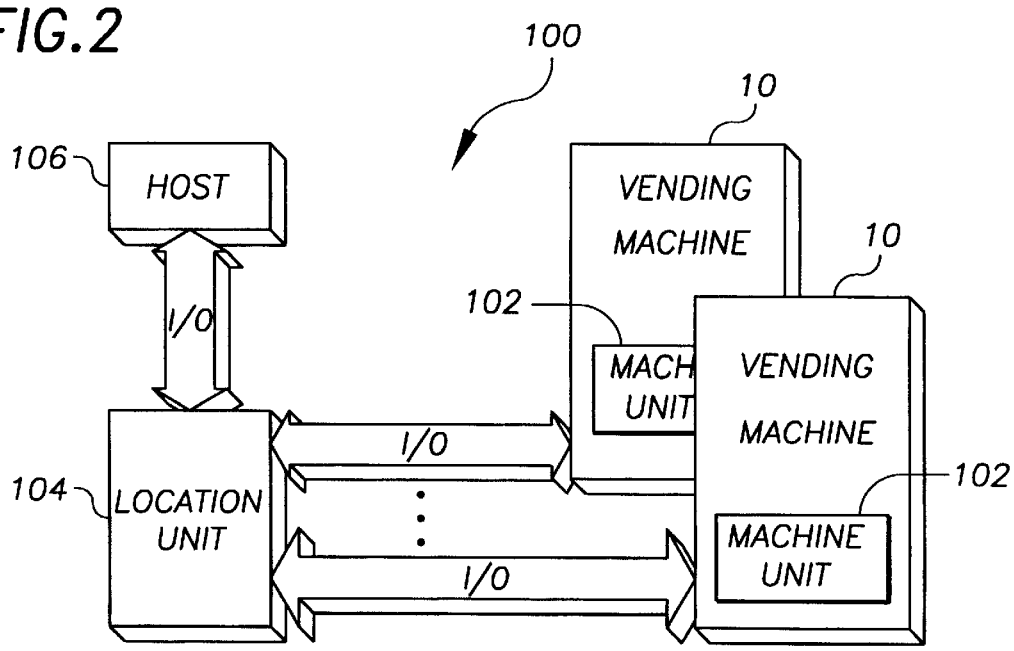
FIG. 2 is a block diagram of a monitoring and data collection system according to the present invention.

FIG. 2 is a block diagram of a monitoring system 100 according to the present invention. Monitoring system 100 includes a plurality of vending machines 10 (such as described with reference to FIGS. 1 and 1A–1H) each equipped with a machine unit 102. Machine unit 102 monitors the various signals in vending machine 10 to determine whether a vend has occurred.

Machine unit 102 is coupled to a location unit 104. In the preferred embodiment, a plurality of machine units 102 are coupled to a single location unit 104. Machine units 102 are preferably coupled to location unit 104 by the same power phase and communicate with one another using the 110VAC carrier signal. Location unit 104 typically includes memory and other circuitry (which will be described in greater detail later in the specification) and receives and stores the data indicative of vends in vending machines 10.

At predetermined time intervals, location unit 104 initiates communication with a remote host unit 106. Such communication preferably takes place via modem over telephone lines. Location unit 104 dumps discrete transaction data to host unit 106 indicative of the vends which have occurred in the plurality of vending machines 10 coupled to location unit 104. Host unit 106 then manipulates the vend data to arrive at a desirable service schedule for servicing the various vending machines 10 which correspond to location unit 104.

Figure 3:
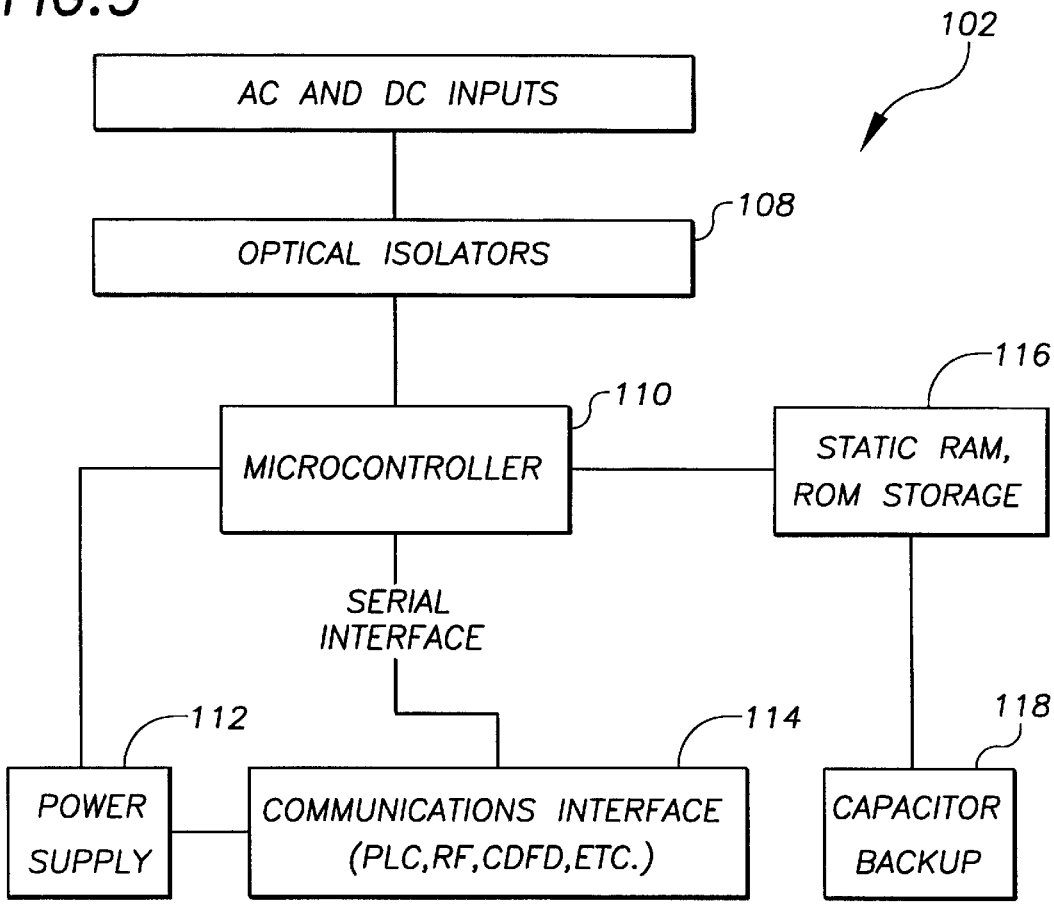
FIG. 3 is a block diagram of a machine unit according to the present invention.

FIG. 3 is a more detailed block diagram of machine unit 102. Machine unit 102 preferably includes optical isolators 108, microcontroller 110, power supply 112, communications interface 114, memory 116 and battery or capacitor back up circuit 118. In the preferred embodiment, machine unit 102 receives a plurality of AC and DC inputs from vending machines 10. Such inputs include either the qualifier signal and the motor/sold out signal or the credit signal, the motor/sold out signal, and the correct change signal from the associated vending machine 10.

The AC and DC signals are received by optical isolators 108 which are commercially available known devices and which isolate noise and other transients on the input signals from the rest of machine unit 102. The optical isolators provide signals to microcontroller 110. In the preferred embodiment, microcontroller 110 is a digital computer or other appropriate microprocessor, along with associated support circuitry.

Memory 116, in the preferred embodiment, includes static random access memory (RAM) and read only memory (ROM) which holds appropriate instruction sets for the operation of microcontroller 110. Microcontroller 110 specifically monitors the credit signal, the motor/sold out signal and the correct change signal from vending machines 10. Microcontroller 110 can use any suitable monitoring algorithm including these three signals to determine whether a vend has occurred. In one preferred embodiment, microcontroller 110 is configured to mask off any motor/sold out signals which are asserted indicating that a product is sold out. Microcontroller 110 is then configured to detect a falling edge of the qualifier signal. This indicates that a vend is taking place. Microcontroller 110 then monitors the unmasked motor/sold out signals to detect which bin corresponds to the motor vending the product.

In the preferred embodiment in which the qualifier signal is inaccessible, microcontroller 110 again masks the motor/sold out signals corresponding to bins which are sold out. Microcontroller 110 is configured to detect a falling edge of correct change signal 34 and the rising and falling edges of the credit signal at 36 and 42. This indicates that a vend is about to take place. Thus, microcontroller 110 monitors the motor/sold out signals. Then, upon the rising edge 46 (or 52 in FIGS. 1B and 1C) of the correct change signal, microcontroller 110 determines which of the motor/sold out signals was in the asserted position immediately prior to the transition 46 (or 52). The motor/sold out signal which is asserted during the time period just prior to the transition 46 (or 52) of the correct change signal always corresponds to the motor which is vending the product.

Once a vend is detected, microcontroller 110 causes discrete transaction information to be stored in memory 116. The transaction information indicates, in a preferred embodiment, the particular bin from which the product was vended.

This information is stored in memory 116 for any suitable time interval. After the time interval has passed, location unit 104 accesses machine unit 102 to retrieve the information from memory 116. It should be noted that capacitor or battery back up circuit 118 is provided to retain information in memory 116 should power supply 112 provided in machine unit 102 fail.

Figure 4:
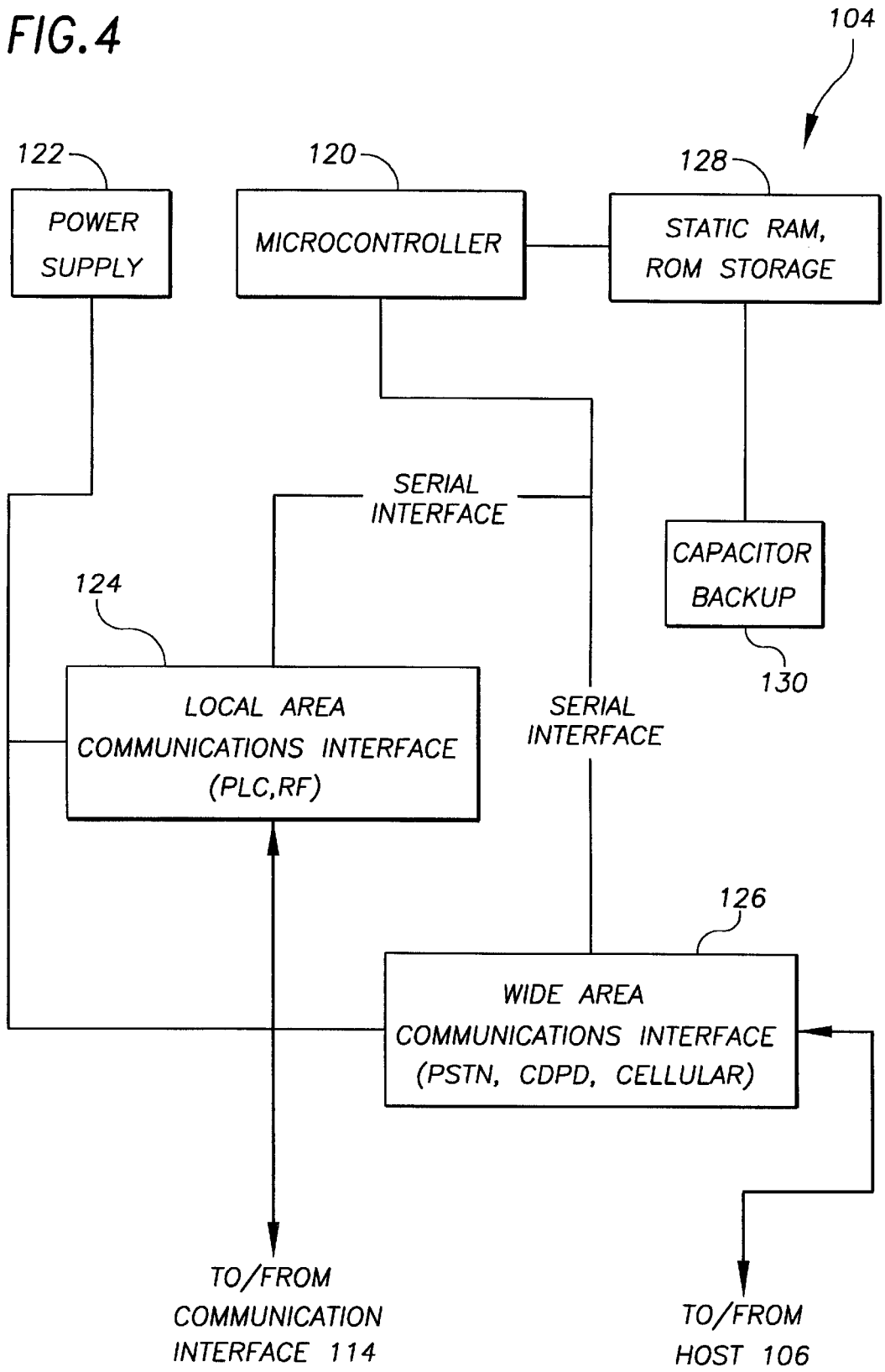
FIG. 4 is a block diagram of a location unit according to the present invention.

FIG. 4 is a more detailed block diagram of location unit 104. Location unit 104 includes microcontroller unit 120, power supply 122, local area communications interface 124, wide area communication interface 126, memory 128 and capacitor or battery back up 130. In the preferred embodiment, local area communications interface 124 communicates with the communications interface 114 of machine unit 102. Such interfaces may typically includes Power Line Carrier Communication (PLC as discussed above), Radio Frequency Communication (RF) or other suitable interfaces.

Microcontroller 120 is also a digital computer, microprocessor or other suitable processor with associated support circuitry. Microcontroller 120 retrieves the transaction information from machine unit 102 via local area communications interface 124.

Location unit 104 typically polls the various machine units 102 and requests information from a number of them at predetermined intervals. Typically, the poll interval is approximately 1 to 1.5 minutes. All machine units must be on the same power phase as the location unit when the location unit communicates with the machine units over the 110 volt power line carrier signal. The information received at location unit 104 is stored in memory 128, which preferably includes static RAM and ROM.

All of the information received by location unit 104 is placed in one of several buffers depending on its priority. The particular number of-buffers is application dependent. In one preferred embodiment, three buffers are used. If the information received from machine units 102 is such that it would require an immediate call to host system 106, or to a maintenance site, it is placed in a first high priority buffer and location unit 104 initiates such a call. If the information is of an intermediate priority, indicating that location unit 104 should call host system 106 prior to the next scheduled call time, but not immediately, the information is placed in a second buffer. If the information is only typical vend data, and should be communicated to host system 106 at the next scheduled call time, it is placed in a third, lower priority, buffer.

At a predesignated time, which is typically stored in an instruction set in memory 128, microcontroller 120 initiates communication with host system 106. Such communication is accomplished using wide area communication interface 126 which can be PSTN, CDPD, cellular, or other suitable communications.

Where communication between location unit 104 and host 106 is accomplished via telephone lines, location unit 104 preferably includes a circuit which monitors the off-hook signal from a customer's telephone line. Therefore, location unit 104 can be coupled into an existing telephone line and not inconvenience the customer. Location unit 104 will not initiate a call to host unit 106 until the telephone to which it is attached indicates that no one is using the telephone. Then, even in the middle of a transmission from location unit 104 to host 106, if the customer picks up the telephone, this is detected by location unit 104 and a dial tone is returned to the telephone within 0.3 seconds of the customer picking up the telephone.

The off-hook signal is preferably tied to an interrupt of microcontroller 120 in location unit 104. If microcontroller 120 is interrupted, it does not record that call as a successful call and tries the call again in approximately three minutes. Also, if microcontroller 120 is interrupted, a signal is sent to host system 106 indicating the interruption and host system 106 ignores the information previously received.

When transmitting information to host 106 and after establishing synchronous communication with host 106, location unit 104 typically provides host 106 with the serial number of location unit 104. Host 106 validates this serial number against a stored list of valid serial numbers which it contains in memory. Next, location unit 104 provides data to host 106. This communication is preferably accomplished by the location unit 104 first providing header information to host 106. When that header information is received accurately, host 106 provides an acknowledge signal to location unit 104. Location unit 104 then responds by providing data blocks to host 106. After each data block is provided, host 106 provides an acknowledge signal if the data is received appropriately.

Tables 1–6 indicate one preferred embodiment of the transaction models used in transmitting information from location unit 104 to host 106. The information transmitted from location unit 104 to host 106 includes the machine identification identifying the particular vending machine 10 for which data is being transmitted, the time and date that the data is being transmitted, the event code indicating the type of event which is about to be reported, and data used in reporting the particular event. The machine ID number, the time and date, and the event code are simply represented by an adequate number of bytes to convey the necessary data.

Table 1 illustrates the transaction models used to indicate a vend. Ten bytes of information are used to convey that transaction information. Four bytes are used to provide the machine identification number. Two bytes and three bits are used to provide the time, and five bits are used to provide the date. An event code is provided in one byte of information and two data variable bytes are provided. In the case where a vend is conveyed, the first data variable byte contains a number which indicates the slot from which the vend was made. In the preferred embodiment, this variable can be any number between 0 and 255.

Table 2 illustrates the record model for money collection data which is transmitted. Six elements of information are transmitted, including total vends since the last service, total cash to the cash box since the last service, total cash to the change tubes since the last service, total bills received since the last service, total cash dispensed since the last service, and total cash inventoried since the last service. Each of these six elements are represented by a two byte variable for a maximum number representable of 65535. In other words, if the machine were to receive all nickels, the machine would indicate that 65535 nickels (or $3,276.75) had been received since the last service.

Table 3 is a transaction model which can be enabled to indicate products which are loaded by a driver into each slot during a service call. One byte of information indicates the length of data to follow. This byte indicates the number of slots for which information will be transmitted. Then, two bytes of information are input by the driver at the vending machine for each slot number. The first byte of information indicates the particular number of the slot for which the data is being transmitted. The second byte indicates the number of items loaded by the driver into the previously identified slot number. The host system receives this information and adds the number of products loaded to the number of products previously in the bin. This continues until data has been transmitted for each slot identified.

Table 4 illustrates a record model for transmitting data indicative of a legal door open event. A two-byte data variable is transmitted which contains a security code or password which must accompany a legal door open transmission.

A number of other events do not require independent data variables. They are transmitted in a form illustrated in Table 5. The mere existence of an event record yields all necessary information. While the data variables are transmitted, they are ignored by host 106.

Dialing strings are used in the location unit to iniate a communication with host 106. When the dialing strings are changed manually, a transaction record is generated and stored in the buffer location unit 104. This information is conveyed using the record model set out in Table 6.

While it is possible for host system 106 to transmit information out to location units 104, this will be done only when location unit 104 initiates a call to host system 106 in order that host system 106 will not interrupt a customer who may be on the telephone which is coupled to location unit 104. An item of information which is sent to location unit 104 may include a new personal identification number which must be used in the machine in order to open the door to the machine, or a new time at which the location unit 104 is to call host system 106. For example, if a high volume of call activity is received by host system 106 at one time, host system 106 may communicate with various location units 104 and spread out the call back times at which location units 104 will next call in to host system 106.

Figure 5:
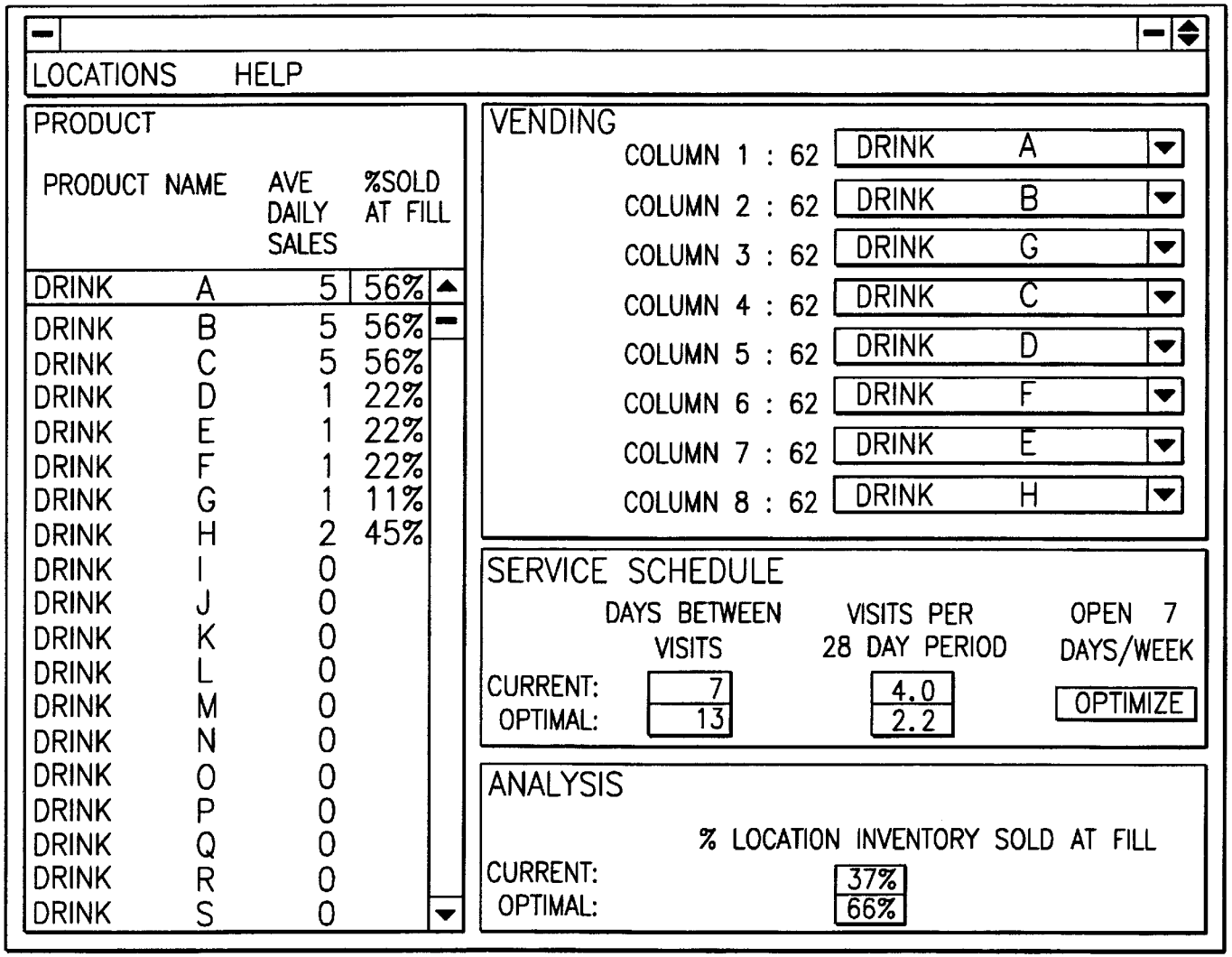
FIG. 5 is one embodiment of a display according to the present invention.

After having received the appropriate data, host unit 106 is configured to manipulate the data to generate desirable information FIG. 5 is one embodiment of the vend data displayed according to the present invention. On the left side of the screen, product information is displayed. The average daily sales (in units) is displayed for each product, along with the percent of that product sold from a given vending machine 10 at the time that vending machine was last filled. For instance, in FIG. 5, five units of brand A cola were sold, on average, each day. When the vending machine associated with this information was last filled, 56% of brand A cola had been sold. The same is true for brand B cola and brand C cola. However, brand D soft drink had only one unit sold, on average, per day. Only 22% of that product had been sold at the last fill.

In the upper right quadrant of FIG. 5, vending data is displayed. Typically, vending machines 10 include approximately 8 columns or bins suitable for holding soft drinks. Such machines typically have a number of large and small bins for more quickly and more slowly selling products, respectively. For example, the bins commonly hold either 62 or 32 soft drink cans. These bins are labeled column 1 to column 8, and their capacity (either 62 cans or 32 cans) is displayed adjacent the column display. Also, the particular brand of product in each of these bins is also displayed.

Below the vending data is a service schedule. The service schedule display shows the current number of days between visits (or service calls) to the vending machine 10, and the current number of visits per 28 day period. Also, the service schedule display includes an optimal number of days between visits and an optimal number of visits per 28 day period. For example, given the fact that only 56% of the most popular product was sold out at the last visit, the optimal number of days between service calls nearly doubles that of the current number of days. In addition, the number of visits per 28 day period would be nearly half of the current number of visits. The optimal service schedule is preferably computed based on an extrapolation of when the first bin would sell out of inventory.

Beneath the service schedule information, other analysis information is displayed. In the embodiment shown in FIG. 5, the percent of the total location inventory sold (for the particular vending machine under consideration) at the time of the last fill is indicated. Also, the percent of the total location inventory sold if the optimal service schedule were followed is also displayed. In the embodiment shown in FIG. 5, only 37% of the total location inventory was sold at the last fill. However, if the optimal service schedule were followed, 66% of the inventory would have been sold. Host system 106 calculates the optimal service schedule and the percent of inventory which would be sold under the optimal service schedule based on the vend data received from location unit 104.

Host unit 106, in the preferred embodiment, is a digital computer with a monitor or other suitable display, as well as with an operator input mechanism, such as a keyboard, membrane keypad, or other suitable operator input device. Therefore, the operator of host 106 is provided with the opportunity of reviewing the optimal service schedule and analysis information if the particular products in each of the columns (or bins) were rearranged.

For instance, by reviewing the product display information, it can be seen that brand G soft drink, which was in a bin that had a 62 can capacity, only sold out 11% at the last fill. However, brand H soft drink, which is in a 32 can capacity column sold out 45% at the last fill. Therefore, the operator may wish to switch brand G soft drink from column 4 to column 8, and switch brand H soft drink from column 8 to column 4. This would place a higher selling product in the larger capacity bin size. Host 106 would then recalculate the optimal service schedule and optimal analysis information based on a projection of sales.

In addition, the operator may also wish to review the optimal service schedule if, for example, column 3, instead of containing brand G soft drink, percentage of inventory sold between service calls. At the least, and at a very quick glance, the service provider can see the optimal service schedule given the current configuration in the vending machine, without changing products, and without changing the configuration. This, in itself, greatly increases the effectiveness of the service organization.

Although the present invention has been described with reference to preferred embodiments, workers skilled in the art will recognize that changes may be made in form and detail without departing from the spirit and scope of the invention.

TABLE 1

| FIELD NAME | LENGTH | COMMENTS | |
|---|---|---|---|
| machine ID# | 4 bytes | binary number. | 1st byte is LSB, 4th byte is MSB |
| time | 2 bytes & 3 bits | binary number. | 5th byte is LSB, 7th byte is MSB |
| date | 5 bits | binary number. | bit 7, 6, 5, 4, 3 of 7th byte |
| event code | 1 byte | binary number. | 8th byte |
| data variable | 1 byte | binary number. | 9th byte |
| data variable | 1 byte | binary number. | 10th byte |

TABLE 2

| FIELD NAME | LENGTH | COMMENTS | |
|---|---|---|---|
| machine ID# | 4 bytes | binary number. | 1st byte is LSB, 4th byte is MSB |
| time | 2 bytes & 3 bits | binary number. | 5th byte is LSB, 7th byte is MSB |
| date | 5 bits | binary number. | bit 7, 6, 5, 4, 3 of 7th byte |
| event code | 1 byte | binary number. | 8th byte |
| total vends | 2 bytes | binary number. | 9th & 10th byte |
| total cash to box | 2 bytes | binary number. | 11th & 12th byte |
| total cash to tube | 2 bytes | binary number. | 13th & 14th byte |
| total bill | 2 bytes | binary number. | 15th & 16th bytes |
| total cash disp. | 2 bytes | binary number. | 17th & 18th byte |
| total cash invent. | 2 bytes | binary number. | 19th & 20th byte |

TABLE 3

| FIELD NAME | LENGTH | COMMENTS | |
|---|---|---|---|
| machine ID# | 4 bytes | binary number. | 1st byte is LSB, 4th byte is MSB |
| time | 2 bytes & 3 bits | binary number. | 5th byte is LSB, 7th byte is MSB |
| date | 5 bits | binary number. | bit 7, 6, 5, 4, 3 of 7th byte |

TABLE 3-continued

| FIELD NAME | LENGTH | COMMENTS | |
|---|---|---|---|
| event code | 1 byte | binary number. | 8th byte |
| length of data | 1 byte | binary number. | 9th byte |
| slot #1 | 1 byte | binary number. | 10th byte |
| # item 1 | 1 byte | binary number. | 11th byte |
| ..... | ..... | ..... | |
| slot # n | 1 byte | binary number. | depend on length byte |
| # item n | 1 byte | binary number. | depend on length byte |

TABLE 4

| FIELD NAME | LENGTH | COMMENTS | |
|---|---|---|---|
| machine ID# | 4 bytes | binary number. | 1st byte is LSB, 4th byte is MSB |
| time | 2 bytes & 3 bits | binary number. | 5th byte is LSB, 7th byte is MSB |
| date | 5 bits | binary number. | bit 7, 6, 5, 4, 3 of 7th byte |
| event code | 1 byte | binary number. | 8th byte |
| data variable | 2 byte | binary number. | 9th and 10th byte |

TABLE 5

| FIELD NAME | LENGTH | COMMENTS | |
|---|---|---|---|
| machine ID# | 4 bytes | binary number. | 1st byte is LSB, 4th byte is MSB |
| time | 2 bytes & 3 bits | binary number. | 5th byte is LSB, 7th byte is MSB |
| date | 5 bits | binary number. | bit 7, 6, 5, 4, 3 of 7th byte |
| event code | 1 byte | binary number. | 8th byte |
| data variable | 2 byte | (N/A) | 9th and 10th byte |

TABLE 6

| FIELD NAME | LENGTH | COMMENTS | |
|---|---|---|---|
| machine ID# | 4 bytes | 1st, 2nd, 3rd & 4th byte (Don't care about this field) | |
| time | 2 bytes & 3 bits | binary number. | 5th byte is LSB, 7th byte is MSB |
| date | 5 bits | binary number. | bit 7, 6, 4 of 7th byte |
| event code | 1 byte | binary number. | 8th byte |
| data variable | 2 bytes | 9th & 10th byte (Don't care about this field) | |
| LU serial number | 6 bytes | Hex number. | 11th byte is LSB 16th byte is MSB |
| dialing string | 36 bytes | ASCII | 17th byte is MSB 52nd byte is LSB |
| | | The string is ended with ODh | |

What is claimed is:

1. A system for monitoring a first plurality of vending machines, comprising:

a first plurality of machine units;

each of said first plurality of machine units being connected to a corresponding vending machine from said first plurality of vending machines for accumulating data from said corresponding vending machine;

a first location unit connected to said first plurality of machine units;

a host unit;

means for transmitting said data from said first plurality of machine units to said first location unit;

location unit storage means for storing said data in said first location unit;

means for transmitting said data from said first location unit to said host unit at a predetermined time; and optimizing means in said host unit for manipulating said data and producing an optimal service schedule for said first plurality of vending machines.

2. A system according to claim 1, wherein all data received by said location unit is one of high priority data, intermediate priority data, and ordinary priority data; said location unit storage means comprising:

a first buffer for storing high priority data received from said first plurality of machine units;

a second buffer for storing intermediate data received from said first plurality of machine units; and a third buffer for storing data received.

3. A system according to claim 1, further comprising means for said location unit to send a location unit identification to said host unit.

4. A system according to claim 1, wherein said data comprises identification data, vend data, cash data, and product data.

5. A system according to claim 1, further comprising means for transmitting data from said host unit to said first location unit.

6. A system according to claim 1, wherein said optimal service schedule is determined by extrapolating a date by which a bin in one of said vending machines first becomes empty.

7. A system according to claim 1, wherein said optimizing means includes basing said optimal service schedule on a hypothetical rearrangement of particular products in particular bins of said plurality of vending machines.

8. A system according to claim 1, wherein said optimizing means includes basing said optimal service schedule based on a projection of sales.

9. A system according to claim 1, wherein each of said plurality of machine units monitors a credit signal, a motor/sold out signal, and a correct change signal of its corresponding vending machine.

10. A system according to claim 9, wherein each of said plurality of machine units determines that a product has vended by masking off any motor/sold out signals which are in an asserted position, detecting a falling edge of a qualifier signal, and monitoring all unmasked motor/sold out signals to detect which bin corresponds to the vended product.

11. A system according to claim 9, wherein each of said plurality of machine units determines that a product has vended by masking off any motor/sold out signals which are in an asserted position, detecting a falling edge of said correct change signal, detecting a rising and falling edge of said credit signal, detecting a rising edge of said correct change signal, and determining which motor/sold out signal was in an asserted position immediately prior to said correct change signal changing from a non-asserted position to an asserted position to detect which bin corresponds to the vended product.

12. A system according to claim 1, wherein at least one of said first plurality of machine units is connected to a microprocessor pre-installed in said vending machine.

* * * * *